United States Patent [19]

Zettier

[11] Patent Number: 4,482,344

[45] Date of Patent: Nov. 13, 1984

[54] CENTRIFUGE DRUM FOR CLARIFYING AND SEPARATING LIQUIDS

[75] Inventor: Karl-Heinz Zettier, Oelde, Fed. Rep. of Germany

[73] Assignee: Westfalia Separator AG, Oelde, Fed. Rep. of Germany

[21] Appl. No.: 569,014

[22] Filed: Jan. 9, 1984

[30] Foreign Application Priority Data

Feb. 16, 1983 [DE] Fed. Rep. of Germany ..... 3305215

[51] Int. Cl.[3] ..... B04B 1/08

[52] U.S. Cl. ..... 494/70

[58] Field of Search ..... 210/371, 380.1; 494/64, 494/67, 68, 69, 70, 71, 72, 73, 76, 85

[56] References Cited

U.S. PATENT DOCUMENTS 2,214,831 9/1940 Hall ..... 494/71 X 3,047,214 7/1962 Downing ..... 494/70 X 3,484,040 12/1969 Honeychurch ..... 494/71 X

*Primary Examiner*—Robert W. Jenkins

*Assistant Examiner*—Arthur D. Dahlberg

*Attorney, Agent, or Firm*—Sprung, Horn, Kramer & Woods

[57] ABSTRACT

A centrifuge consisting of a bottom, a cover, and a closure ring that unites them. The liquid being centrifuged is conveyed through an inlet pipe to an inlet chamber. Bores extend from the inlet chamber down to a surface that demarcates the bottom of the drum. Each bore is provided with an insert in the form of a choking device that has an outlet channel. Each outlet channel empties into a vestibule. The vestibules communicate with rising channels in a disk stack. The distributor and the bottom of the drum can be in one piece.

5 Claims, 3 Drawing Figures

CENTRIFUGE DRUM FOR CLARIFYING AND SEPARATING LIQUIDS

BACKGROUND OF THE INVENTION

The present invention relates to a centrifuge drum for clarifying and separating liquids and having a bottom, a cover, a closure ring that unites them, and a stationary inlet pipe that extends into the inlet chamber of a distributor, wherein bores, each of which is provided with an insert in the form of a choking device that has an outlet channel, extend from the inlet chamber and the outlet channels empty into a vestibule that communicates with the rising channels of a disk stack inserted in the drum.

A centrifuge drum of this type is known from FIG. 2 of German OS No. 3 019 737. The distributor, which has bores to accept the inserts, is a separate component. The inserts must be installed before the distributor can be installed in the bottom of the drum. The whole drum has to be disassembled to replace the inserts.

SUMMARY OF THE INVENTION

The main object of the present invention is to provide a centrifuge drum of the aforesaid type in which the inserts can be installed from below the drum and are easy to replace.

This object is achieved in accordance with the invention in that bores containing the inserts extend down to a surface that demarcates the bottom of the drum and the inserts are installed through the bottom of the each bore.

In one practical embodiment of the invention the conical outer surface of the distributor, the surface that the disk stack rests on, has several vestibules one on top of another and each rising channel in the plate package can be associated with a vestibule.

In the design in accordance with the invention, the inserts can be selected to channel the liquid being centrifuged from the inlet chamber to either the outer, the inner, or the intermediate rising channels. This makes it possible to make a more or a less extensive depositing surface or depositing surfaces of the same size available in the disk stack to the light or to the heavy phase of the liquid being centrifuged.

Since the inserts in the drum in accordance with the invention can be installed in various bores that connect the bottom of the drum with with inlet chamber from under the drum and since the distributor does not have interior ribs like those illustrated in FIG. 1 of German OS No. 3 019 737, the distributor and the bottom of the drum can be in one piece. The component can be forged and machined, resulting in considerable manufacturing and assembly advantages over a design in which the distributor and the bottom of the drum are separate components.

A one-piece design for the distributor and bottom of the drum is also more sanitary because solid residue accumulates in any mating joint and is difficult or impossible to remove by rinsing the circulation system. Residues of this type are especially detrimental in centrifuges employed in the foodstuffs field where they constitute sites of infection.

Some preferred embodiments of the invention will now be described with reference to the attached drawings, wherein

DETAILED DESCRIPTION OF THE PREFERRED EMBODIMENTS

Figure 1:
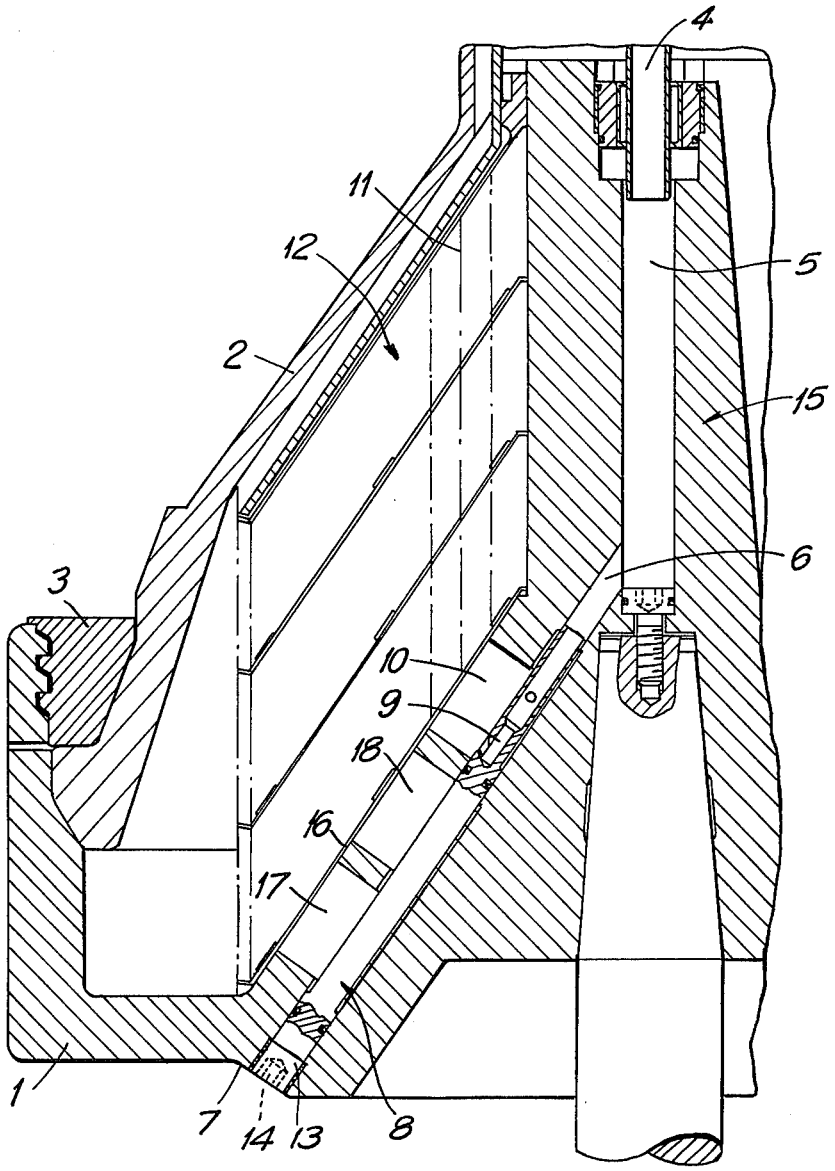
FIG. 1 is a partial vertical section through a centrifuge drum according to the invention.
Figure 2:
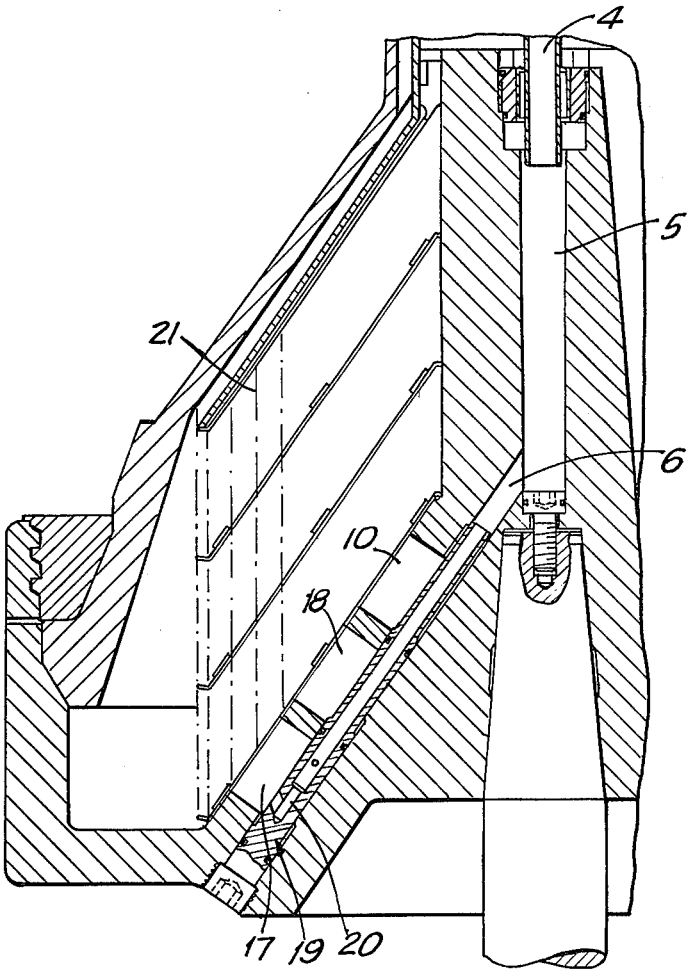
FIG. 2 is vertical section through the centrifuge drum in FIG. 1 with a different type of insert according to the invention.

The centrifuge drum in FIG. 1 and 2 consists of a bottom 1, a cover 2, and a closure ring 3 that unites them.

A stationary inlet pipe 4 for the liquid to be clarified or separated empties into an inlet chamber 5. Bores 6 are distributed around the circumference of the drum and extend from inlet chamber 5 down to a surface 7 that demarcates the bottom 1.

The bottom opening of each bore 6 constitutes the installation access for an insert 8 that has an outlet channel 9 opening into a vestibule 10. Each insert 8 chokes, in conjunction with its outlet channel 9, the liquid flowing out of inlet chamber 5.

Vestibule 10 communicates with the rising channel 11 of a disk stack 12 inside the drum. Rising channels 11 are represented by the dot-and-dash lines in FIG. 1.

Figure 3:
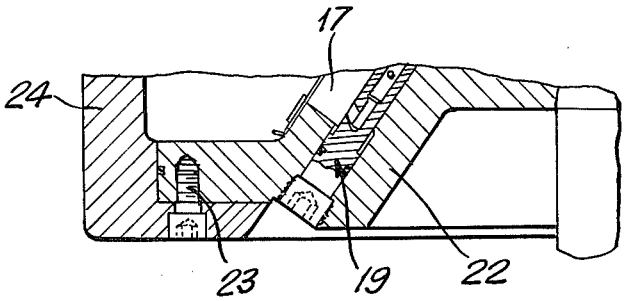
FIG. 3 is a vertical section through a two-part centrifuge drum according to the invention.

As will be evident from FIG. 3, the inside of the bottom of each bore 6 is threaded and a threaded mount 13 on insert 8 that is provided with an internal polygon 14 screws into it.

Insert 8 can also have an exterior polygonal head or a round head equipped with a slot to accept an activating tool. A threaded mount that screws like threaded mount 13 in FIG. 1 into the threading inside bore 6 will also be employed adjacent to a head of this type.

Each bore in this embodiment empties into a recess that accepts the head of the insert and begins at the lower demarcating surface of the bottom of the drum.

The distributor 15 and the bottom 1 of the drum in the embodiments illustrated in FIG. 1 and 2 are in one piece. The conical outer surface 16 of the distributor, the surface that the disk stack rests on, has several vestibules 10, 17, and 18, one on top of another.

Whereas the outlet channel 9 in the insert 8 illustrated in FIG. 1 empties into a vestibule 10 that communicates with rising channels 11 that are farther inside the drum, the inserts 19 in the bores 6 in the embodiment illustrated in FIG. 2 have outlet channels 20 that empty into a vestibule 17 that communicates with rising channels 21 that are farther outside.

Thus, various types of inserts can be selected to channel the liquid being centrifuged from inlet chamber 5 to vestibules 10, 18, or 17 as desired and hence to either the outer or the inner rising channels of the disks.

The distributor and the bottom of the drum in the embodiment illustrated in FIG. 3 are not in one piece but consist of an interior component 22 and of jacket component 24 connected to it by screws 23.

It will be appreciated that the instant specification and claims are set forth by way of illustration and not limitation, and that various modifications and changes may be made without departing from the spirit and scope of the present invention.

What is claimed is:

1. In a centrifuge drum for clarifying and separating liquids and having a bottom, a cover, a closure ring that unites the bottom and cover, a stationary inlet pipe that extends into the inlet chamber of a distributor in the drum, bores extending from the inlet chamber, an insert disposed in each bore and comprising a choking device that has an outlet channel, the outlet channels emptying into a vestibule that communicates with rising channels of a disk stack inserted in the drum, the improvement wherein the bores containing the inserts extend down to the surface demarcating the bottom of the drum and are receptive of the inserts through the bottom of the each bore.

2. The centrifuge drum as in claim 1, wherein the distributor has a conical outer surface on which the disk stack rests and having several vestibules one above the other.

3. The centrifuge drum as in claim 1, wherein each bore is threaded at the bottom and further comprising a threaded mount screwed into threaded portion of the bore.

4. The centrifuge drum as in claim 3, wherein the bottom of each insert has one of an internal polygon and slot that accepts an activating tool for turning same.

5. The centrifuge drum as in claim 1, wherein the distributor and the bottom of the drum are in one piece.

* * * * *